US009715973B2

(12) United States Patent
Chao

(10) Patent No.: US 9,715,973 B2
(45) Date of Patent: Jul. 25, 2017

(54) KEYSWITCH AND KEYBOARD THEREOF

(71) Applicants: DARFON ELECTRONICS (SUZHOU) CO., LTD., Suzhou, Jiangsu Province (CN); DARFON ELECTRONICS CORP., Taoyuan (TW)

(72) Inventor: Ling-Hsi Chao, Taoyuan (TW)

(73) Assignees: DARFON ELECTRONICS (SUZHOU) CO., LTD., Suzhou, Jiangsu Province (CN); DARFON ELECTRONICS CORP., Taoyuan (TW)

( * ) Notice: Subject to any disclaimer, the term of this patent is extended or adjusted under 35 U.S.C. 154(b) by 0 days.

(21) Appl. No.: 15/194,548

(22) Filed: Jun. 27, 2016

(65) Prior Publication Data

US 2017/0011867 A1 Jan. 12, 2017

(30) Foreign Application Priority Data

Jul. 8, 2015 (TW) ..... 104122131 A

(51) Int. Cl.

| | |
|---|---|
| ***H01H 13/14*** | (2006.01) |
| ***H01H 13/70*** | (2006.01) |
| ***H01H 3/12*** | (2006.01) |
| ***H01H 13/705*** | (2006.01) |

(52) U.S. Cl.

CPC ..... *H01H 13/14* (2013.01); *H01H 3/125* (2013.01); *H01H 13/70* (2013.01); *H01H 13/705* (2013.01)

(58) Field of Classification Search

CPC ..... H01H 13/14; H01H 13/70; H01H 3/125; H01H 13/705; H01H 2227/036

USPC ..... 200/5 A, 517, 344–345, 314, 317, 512; 400/490–496

See application file for complete search history.

(56) References Cited

U.S. PATENT DOCUMENTS

| | | | | |
|---|---|---|---|---|
| 7,173,200 | B2 * | 2/2007 | Yoneyama | H01H 3/125 200/344 |
| 2011/0155552 | A1 * | 6/2011 | Wang | H01H 3/125 200/5 A |
| 2016/0351349 | A1 * | 12/2016 | Chen | G06F 1/1616 |

FOREIGN PATENT DOCUMENTS

| | | | |
|---|---|---|---|
| CN | 102473039 | A | 5/2012 |
| CN | 102969183 | A | 3/2013 |
| CN | 104091712 | A | 10/2014 |
| JP | 200386048 | | 3/2003 |
| JP | 200439382 | | 2/2004 |
| TW | 432414 | | 5/2001 |

(Continued)

*Primary Examiner* — Edwin A. Leon

(74) *Attorney, Agent, or Firm* — Winston Hsu

(57) ABSTRACT

A keyswitch includes a board, a cap, and a support device. The support device is disposed between the board and the cap and includes first and second support members movably connected to the cap and the board. A stopping member is formed on one of the first support member and the cap. An elastic member is formed on the other one of the first support member and the cap. When the cap is not pressed, the stopping member abuts against the elastic member to keep the cap at a non-pressed position. When the cap is pressed to a pressed position, the cap and the first support member slide relatively to make the stopping member deform the elastic member. When the cap is released, the elastic member drives the cap and the first support member to slide relatively, so as to move the cap back to the non-pressed position.

18 Claims, 11 Drawing Sheets

(56) References Cited

FOREIGN PATENT DOCUMENTS

| | | |
|---|---|---|
| TW | M320163 | 10/2007 |
| TW | 201526060 A | 7/2015 |

* cited by examiner

KEYSWITCH AND KEYBOARD THEREOF

BACKGROUND OF THE INVENTION

1. Field of the Invention

The present invention relates to a keyswitch and a keyboard thereof, and more specifically, to a keyswitch utilizing a stopping member to deform an elastic member so as to provide an elastic force for moving a cap back to its original position and a keyboard thereof .

2. Description of the Prior Art

A keyboard, which is the most common input device, could be found in variety of electronic apparatuses for users to input characters, symbols, numerals and so on. Furthermore, from consumer electronic products to industrial machine tools, they are all equipped with a keyboard for performing input operations.

Please refer to FIG. 1, which is a cross-sectional diagram of a keyswitch 1 according to the prior art. As shown in FIG. 1, the keyswitch 1 includes a board 10, a cap 12, a circuit board 14, a support device 16, and an elastic member 18. The circuit board 14 is disposed on the board 10. The support device 16 is disposed between the cap 12 and the board 10 for supporting the cap 12. The elastic member 18 is also disposed between the cap 12 and the board 10. Accordingly, when the cap 12 is pressed by a user, a triggering portion 19 of the elastic member 18 triggers a switch 15 on the circuit board 14 for performing a corresponding input function. On the other hand, when the cap 12 is released, the elastic member 18 could provide the cap 12 with an elastic force to make the cap 12 return back to its original position.

However, since disposal of the elastic member 18 requires more space so as to further increase the overall height of the keyswitch 1, it is disadvantageous to the thinning design of the keyswitch 1.

SUMMARY OF THE INVENTION

The present invention provides a keyswith including a board, a cap, and a support device. The support device is disposed between the board and the cap. The support device includes a first support member and a second support member. The first support member and the second support member are movably connected to the cap and the board to make the cap move between a non-pressed position and a pressed position with rotation of the first support member and the second support member. A stopping member is formed on one of the first support member and the cap. An elastic member is formed on the other one of the first support member and the cap to abut against the stopping member. When the cap is not pressed, the stopping member abuts against the elastic member to keep the cap at the non-pressed position. When the cap is pressed by an external force to move from the non-pressed position to the pressed position with rotation of the first support member and the second support member, the cap and the first support member slide to make the stopping member deform the elastic member. When the external force is released, the elastic member deformed by the stopping member provides an elastic force to drive the cap and the first support member to slide, so as to move the cap from the pressed position back to the non-pressed position.

The present invention further provides a keyboard including a board and a plurality of keyswitches. The plurality of keyswitches is disposed on the board. At least one of the plurality of keyswitches includes a cap and a support device.

The support device is disposed between the board and the cap. The support device includes a first support member and a second support member. The first support member and the second support member are movably connected to the cap and the board to make the cap move between a non-pressed position and a pressed position with rotation of the first support member and the second support member. A stopping member is formed on one of the first support member and the cap. An elastic member is formed on the other one of the first support member and the cap to abut against the stopping member. When the cap is not pressed, the stopping member abuts against the elastic member to keep the cap at the non-pressed position. When the cap is pressed by an external force to move from the non-pressed position to the pressed position with rotation of the first support member and the second support member, the cap and the first support member slide to make the stopping member deform the elastic member. When the external force is released, the elastic member deformed by the stopping member provides an elastic force to drive the cap and the first support member to slide, so as to move the cap from the pressed position back to the non-pressed position.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
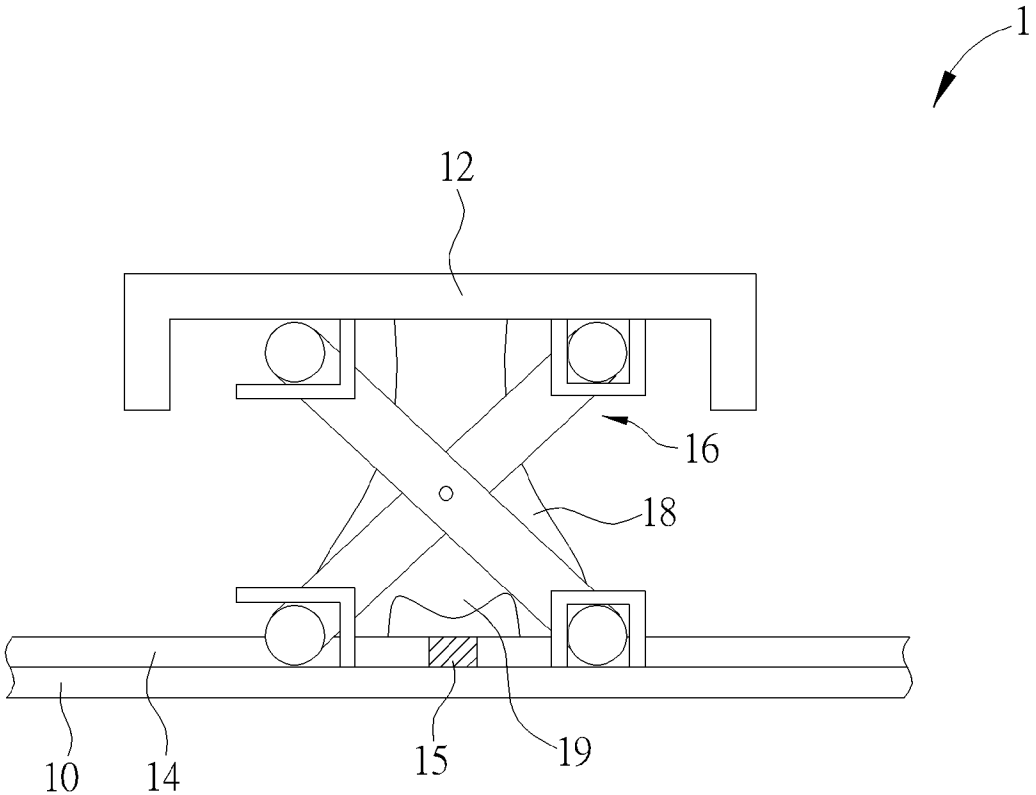
FIG. 1 PRIOR ART
FIG. 1 is a cross-sectional diagram of a keyswitch according to the prior art.
Figure 2:
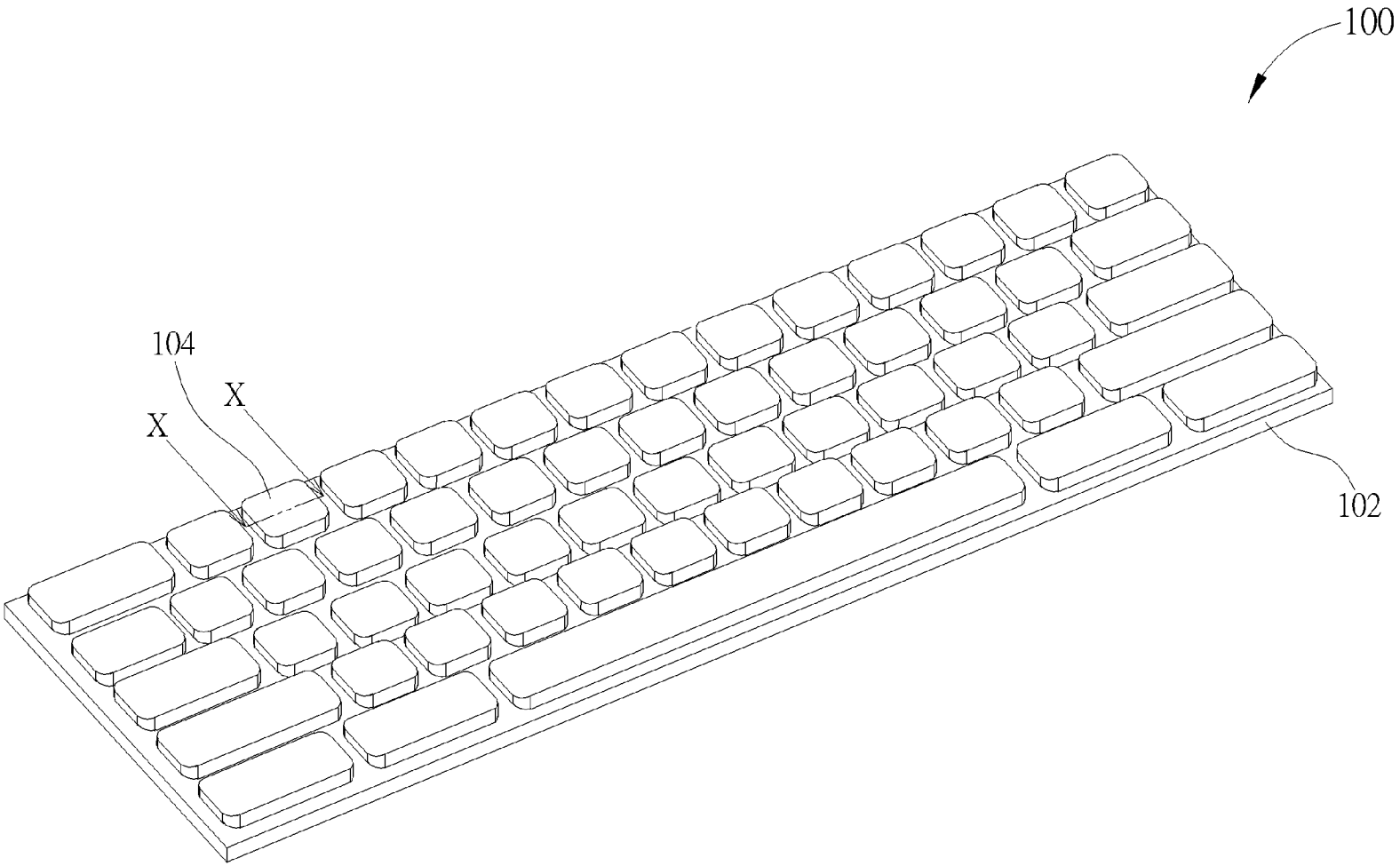
FIG. 2 is a diagram of a keyboard according to an embodiment of the present invention.

Please refer to FIG. 2, which is a diagram of a keyboard 100 according to an embodiment of the present invention. As shown in FIG. 2, the keyboard 100 includes a board 102 and a plurality of keyswitches 104. The plurality of keyswitches 104 is disposed on the board 102 for a user to perform input operations. In this embodiment, the keyboard 100 could be a slim keyboard and the keyswitch 104 could be a slim keyswitch, but not limited thereto. The keyswitch design of the present invention for moving a cap back to its original position via structural linkage between a support device and the cap could be applied to at least one of the plurality of keyswitches 104. In the following, more detailed description for only one keyswitch 104 to which the aforesaid design is applied is provided. As for the related description for other keyswitches 104 adopting the same design, it could be reasoned by analogy.

Figure 3:
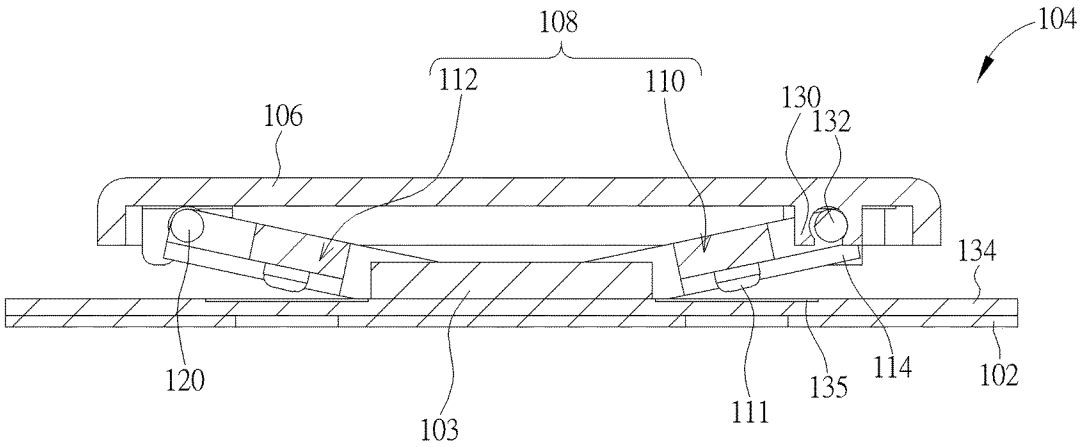
FIG. 3 is a cross-sectional diagram of a keyswitch in FIG. 2 along a cross-sectional line X-X.
Figure 4:
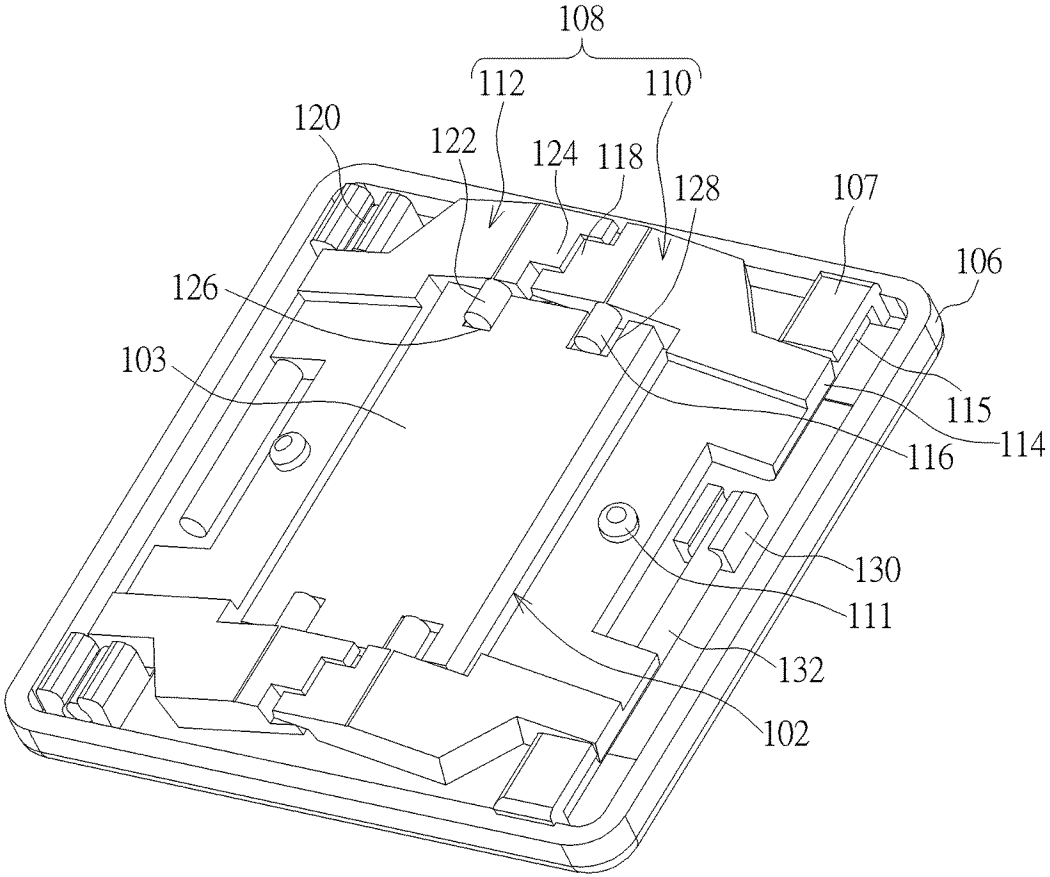
FIG. 4 is an assembly diagram of a board in FIG. 3 with a cap and a support device.
Figure 5:
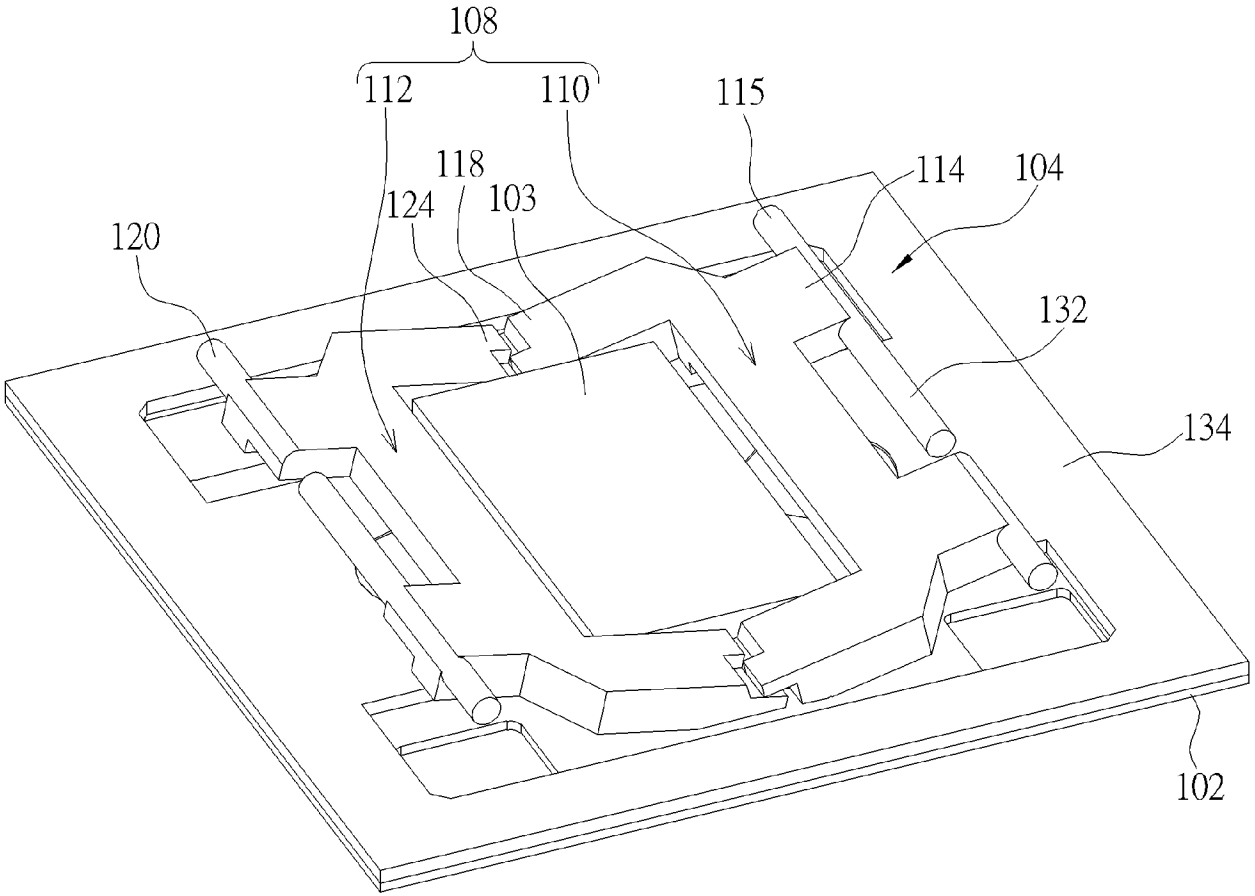
FIG. 5 is an enlarged diagram of the keyswitch in FIG. 2 after the cap is omitted.

Please refer to FIG. 3, FIG. 4, and FIG. 5. FIG. 3 is a cross-sectional diagram of the keyswitch 104 in FIG. 2 along a cross-sectional line X-X. FIG. 4 is an assembly diagram of the board 102 in FIG. 3 with a cap 106 and a support device 108. FIG. 5 is an enlarged diagram of the keyswitch 104 in FIG. 2 after the cap 106 is omitted. For clearly showing the mechanical connection relationship of the board 102, the cap 106, and the support device 108, there is only a connection base 103 on the board 102 depicted in FIG. 4. As shown in FIG. 3, FIG. 4, and FIG. 5, the keyswitch 104 includes the cap 106 and the support device 108. The support device 108 is disposed between the board 102 and the cap 106 and includes a first support member 110 and a second support member 112. The first support member 110 and the second support member 112 are movably connected to the board 102 and the cap 106, so that the cap 106 could move between a non-pressed position and a pressed position with rotation of the first support member 110 and the second support member 112.

To be more specific, in this embodiment, the first support member 110 has a first connection portion 114, a second connection portion 116, and a first linkage portion 118, and the second support member 112 has a third connection portion 120, a fourth connection portion 122, and a second linkage portion 124. The board 102 has the connection base 103. A shaft hole 126 is formed on the connection base 103 corresponding to the fourth connection portion 122, and a slot hole 128 is formed on the connection base 103 corresponding to the second connection portion 116. The first connection portion 114 is slidably connected to the cap 106 (e.g. utilizing a sliding shaft 115 of the first connection portion 114 to be slidably disposed in a sliding slot 107 of the cap 106 as shown in FIG. 4). The second connection portion 116 is slidably disposed in the slot hole 128. The third connection portion 120 is pivotably connected to the cap 106. The fourth connection portion 122 is pivotably disposed in the shaft hole 126. The first linkage portion 118 and the second linkage portion 124 are movably connected to each other to cause linkage movement of the first support member 110 and the second support member 112 when the cap 106 is pressed or released. As shown in FIG. 5, the first linkage portion 118 and the second linkage portion 124 are preferably stacked with each other.

Furthermore, as shown in FIG. 4, in this embodiment, a stopping member 130 is formed on the cap 106 and could be an engaging slot. An elastic member 132 is formed on the first support member 110 corresponding to the stopping member 130. The elastic member 132 could be preferably a pivot shaft (one end could be a free end, but not limited thereto, meaning that the elastic member 132 could adopt the shaft design that two ends of the elastic member 132 are fixed to the first support member 110) and could be pivotably disposed in the engaging slot. In practical application, the keyboard 100 could further include a circuit board 134. The circuit board 134 could be a membrane circuit board, a flexible circuit board, or a printed circuit board. The circuit board 134 has a switch 135 (e.g. a membrane switch or other triggering switch) corresponding to a triggering point 11 of the first support member 110. Accordingly, when the cap 106 of the keyswitch 104 is pressed to the pressed position, the triggering point 111 of the first support member 110 could trigger the switch 135 of the circuit board 134 for performing a corresponding input function.

Figure 6:
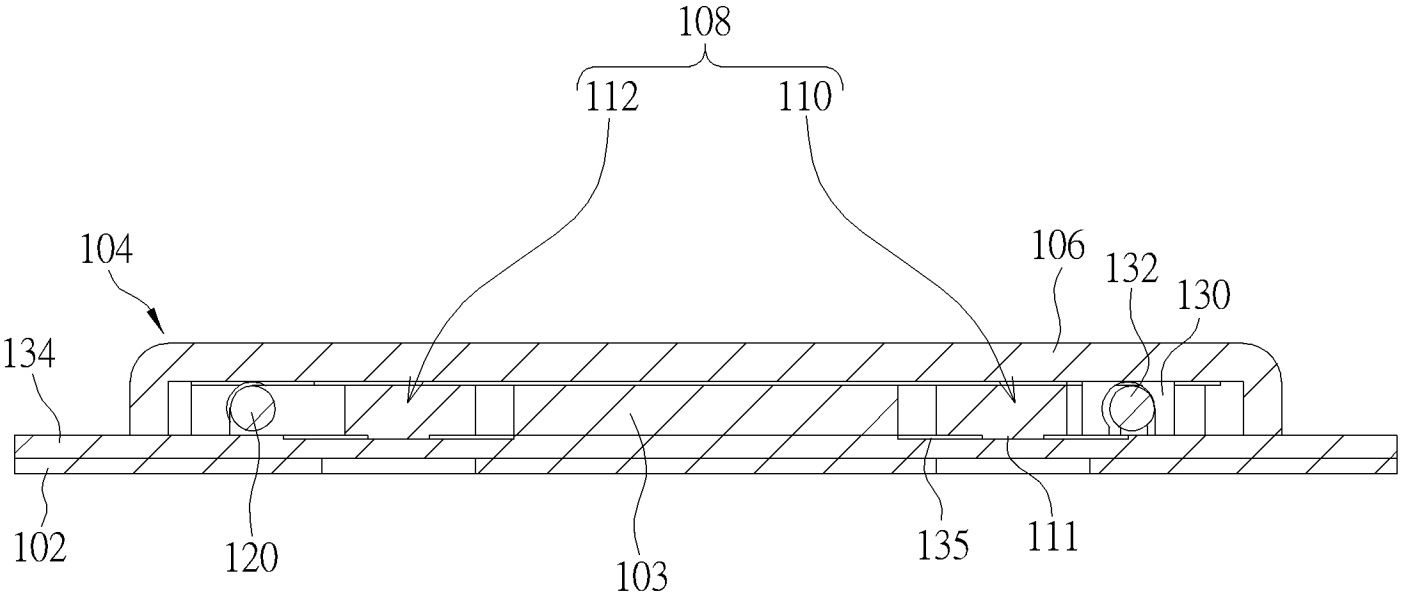
FIG. 6 is a cross-sectional diagram of the cap in FIG. 3 being pressed to the pressed position.
Figure 7:
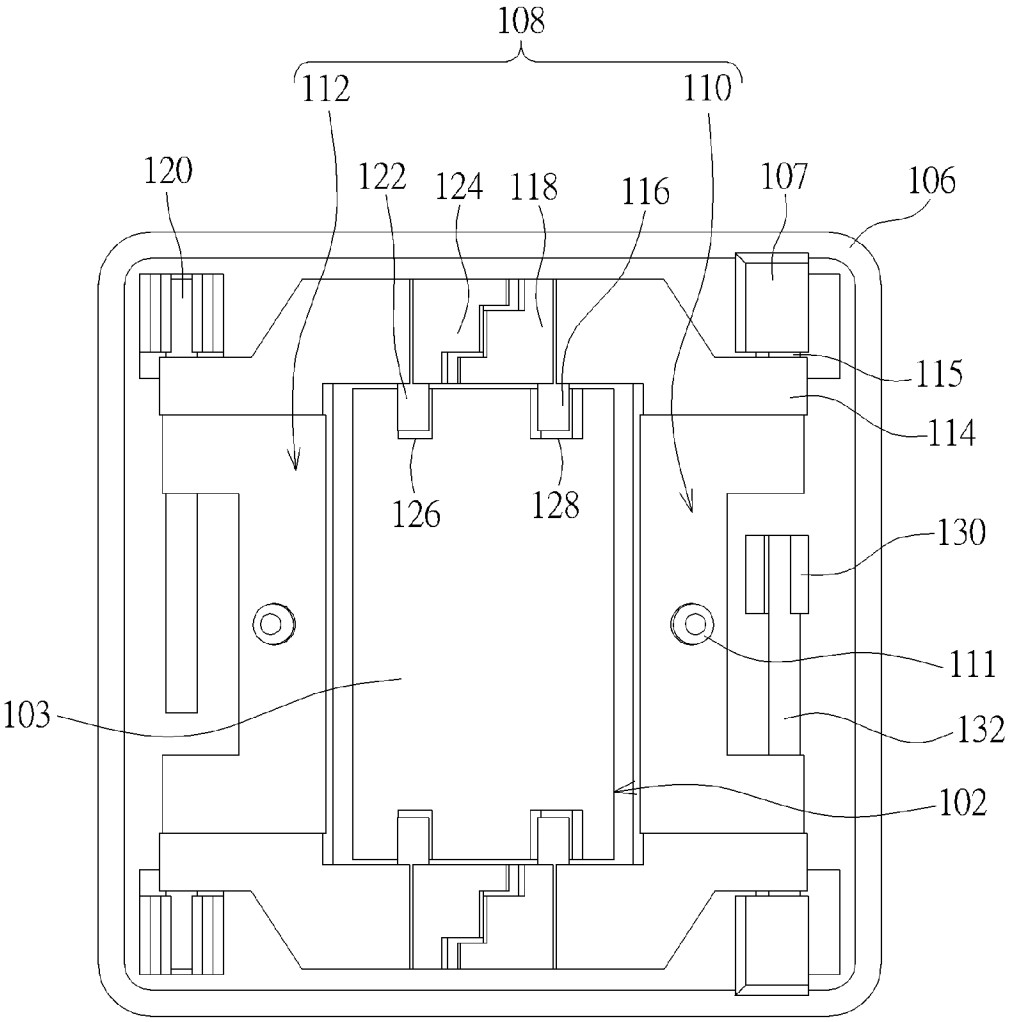
FIG. 7 is an assembly diagram of the board, the cap, and the support device from another viewing angle.
Figure 8:
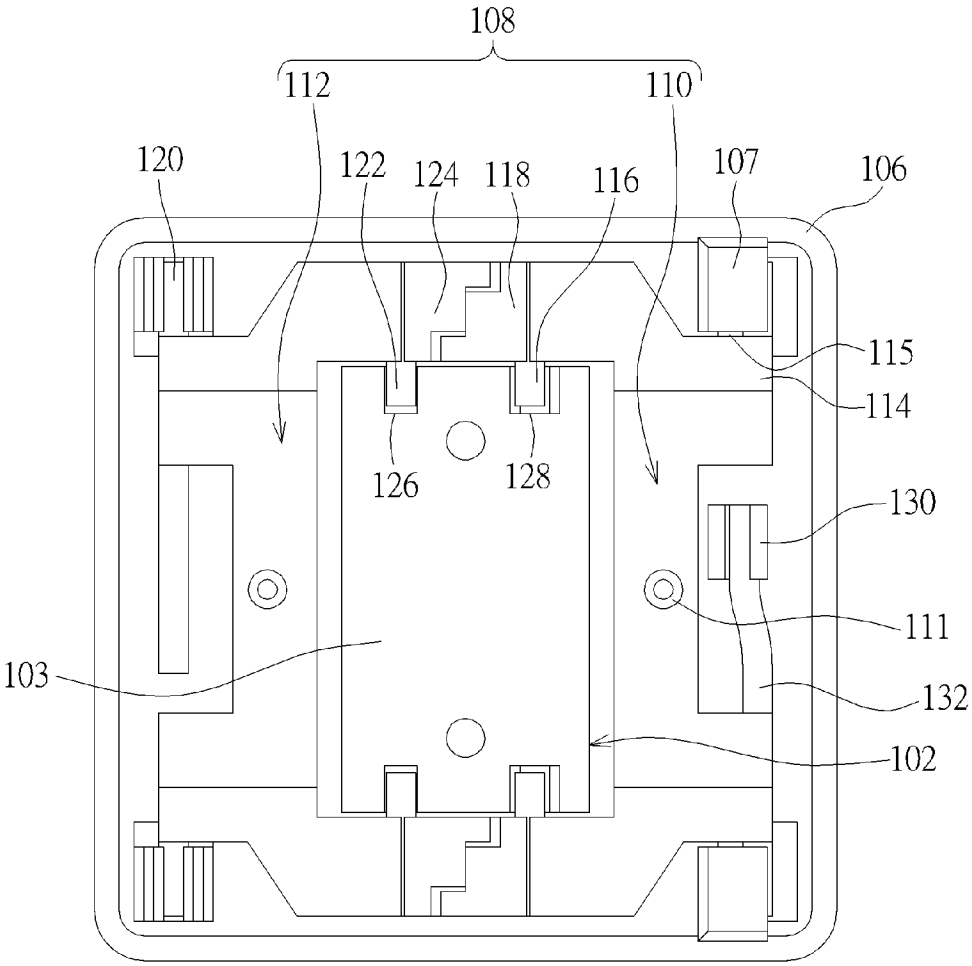
FIG. 8 is a bottom view of the cap in FIG. 6 with the board and the support device when the cap is pressed to the pressed position.

Please refer FIG. 3, FIG. 4, FIG. 6, FIG. 7, and FIG. 8. FIG. 6 is a cross-sectional diagram of the cap 106 in FIG. 3 being pressed to the pressed position. FIG. 7 is an assembly diagram of the board 102, the cap 106, and the support device 108 from another viewing angle. FIG. 8 is a bottom view of the cap 106 in FIG. 6 with the board 102 and the support device 108 when the cap 106 is pressed to the pressed position. For clearly showing the mechanical connection relationship of the board 102, the cap 106, and the support device 108, there is only the connection base 103 depicted in FIG. 8. As shown in FIG. 3, FIG. 4, FIG. 6, FIG. 7, and FIG. 8, when the cap 106 is not pressed, the stopping member 130 could abut against the elastic member 132 to keep the cap 106 at the non-pressed position as shown in FIG. 3. When the cap 106 is pressed by an external force, the second support member 112 takes the fourth connection portion 122 as a pivot point to rotate relative to the cap 106 and the board 102, and the first support member 110 slides relative to the board 102 and the cap 106, so that the cap 106 could move downward from the non-pressed position as shown in FIG. 3 to the pressed position as shown in FIG. 6 with sliding of the first support member 110 and rotation of the second support member 112. Accordingly, the switch 135 of the circuit board 134 could be triggered by the triggering point 111 of the first support member 110 for performing the corresponding input function.

At the same time, with sliding of the first support member 110 relative to the cap 106 and the board 102, the elastic member 132 (i.e. the pivot shaft) on the first support member could be biased by the stopping member 130 (i.e. the engaging slot) from a state of abutting against the stopping member 130 as shown in FIG. 7 to a deformed state as shown in FIG. 8. When the external force is released, the deformed elastic member 132 biased by the stopping member 130 could provide an elastic force to drive the first support member 110 to slide relative to the cap 106. At the same time, via the linkage design of the first linkage portion 118 and the second linkage portion 124, the second support member 112 could take the fourth connection portion 122 as the pivot point to rotate relative to the board 102 and the cap 106, so as to move the cap 106 from the pressed position as shown in FIG. 6 to the non-pressed position as shown in FIG. 3 for achieving the cap returning purpose.

In practical application, the aforesaid design that the elastic member is biased by the stopping member with sliding of the first support member for providing the elastic force to the first support member could also be applied to the second support member for generating the effect that the elastic member could provide the elastic force to the second support member, and the related description could be reasoned by analogy according to the aforesaid embodiment and omitted herein. Furthermore, the forming positions and the structural designs of the stopping member and the elastic member are not limited to the aforesaid embodiment. In other words, all designs in which the stopping member could bias the elastic member with relative sliding of the cap and the support member of the support device to deform the elastic member for moving the cap back to its original position would fall within the scope of the present invention. For example, in another embodiment, the stopping member could be formed on the support member and could be an engaging slot, and the elastic member could be formed on the cap corresponding to the stopping member and could be a pivot shaft to be pivotably disposed in the engaging slot. In another embodiment, the stopping member could be formed on the cap and could be a protruding block, and the elastic member could be formed on the support member corresponding to the stopping member and could be an elastic block to abut against the protruding block. As for other derived embodiments, the related description could be reasoned by analogy according to the aforesaid embodiment and omitted herein.

Figure 9:
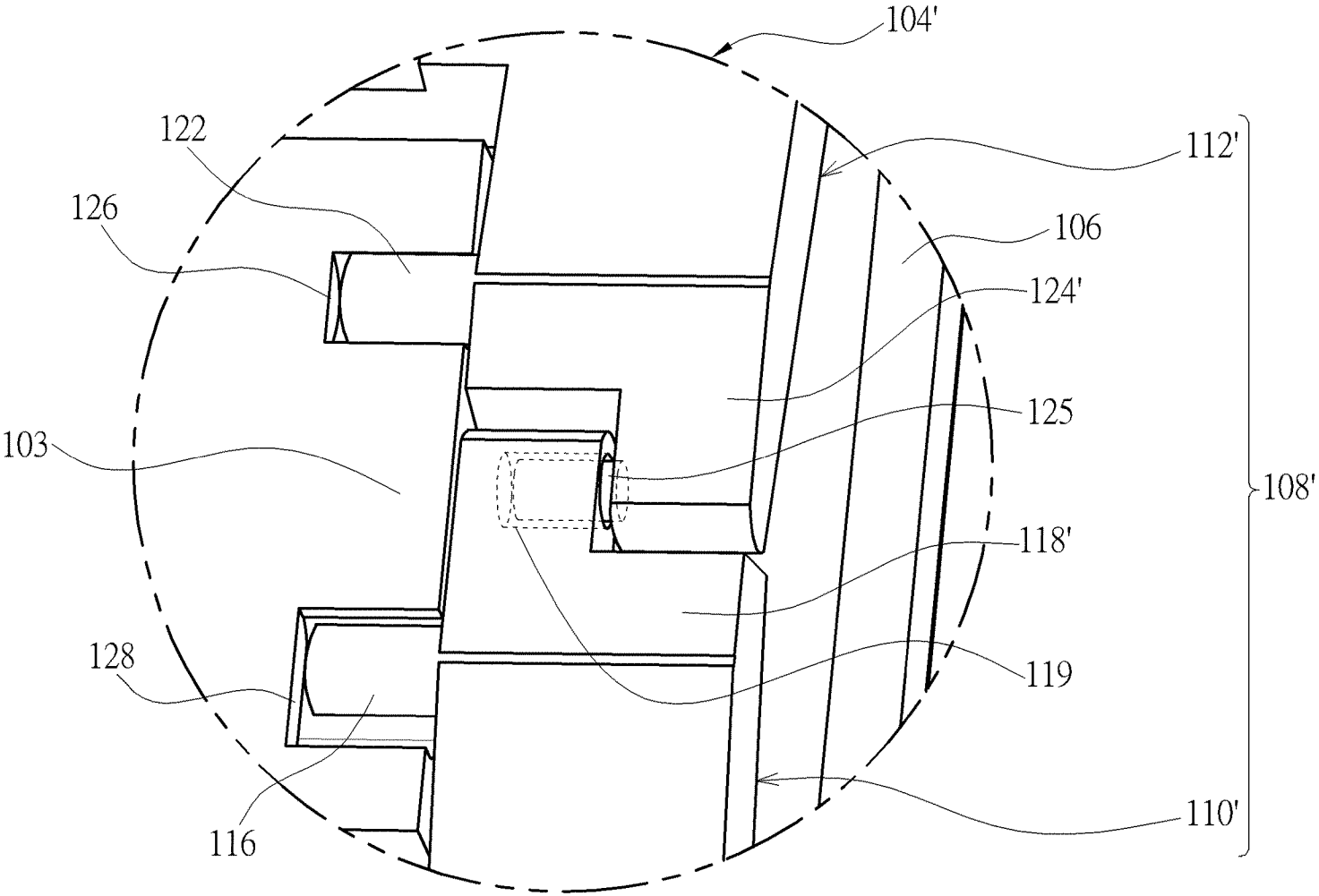
FIG. 9 is a partial enlarged diagram of a keyswitch according to another embodiment of the present invention.

It should be mentioned that the linkage design of the first support member and the second support member is not limited to the aforesaid embodiment. For example, please refer to FIG. 9, which is a partial enlarged diagram of a keyswitch 104' according to another embodiment of the present invention. For clearly showing the mechanical connection relationship of the cap 106 and a support device 108', there is only the connection base 103 on the board 102 depicted in FIG. 9. Components both mentioned in this embodiment and the aforesaid embodiments represent components with similar structures or functions. As shown in FIG. 9, the keyswitch 104' includes the cap 106 and the support device 108'. The support device 108' includes a first support member 110' and a second support member 112'. The first support member 110' has the first connection portion 114 (not shown in FIG. 9), the second connection portion 116, and a first linkage portion 118'. The second support member 112' has the third connection portion 120 (not shown in FIG. 9), the fourth connection portion 122, and a second linkage portion 124'. In this embodiment, the first linkage portion 118' and the second linkage portion 124' could be preferably connected to each other in a shaft-hole fitting manner (e.g. utilizing a pivot shaft 125 of the second linkage portion 124' to be pivotably disposed in a shaft hole 119 of the second linkage portion 118'), so as to cause linkage movement of the first support member 110' and the second support member 112' when the cap 106 is pressed or released.

Furthermore, the design for connecting the first support member and the second support member to the cap and the board is not limited to the aforesaid embodiments. That is, all designs in which the first support member and the second support member are movably connected to the cap and the board to make the stopping member bias the elastic member with sliding of the first support member relative to the cap for deforming the elastic member would fall within the scope of the present invention. For example, please refer to FIG. 10, which is a side view of a keyswitch 104" according to another embodiment of the present invention. For clearly showing the structural design of a support device 108", the cap 106 is briefly depicted by dotted lines in FIG. 10. Components both mentioned in this embodiment and the aforesaid embodiments represent components with similar structures or functions.

Figure 10:
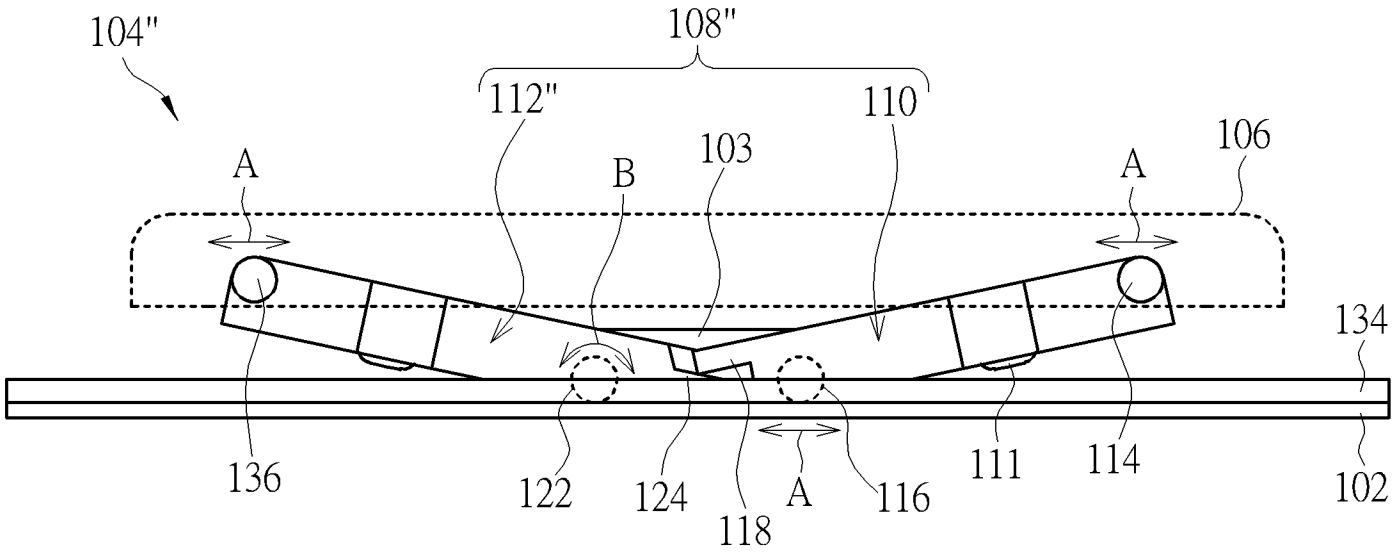
FIG. 10 is a side view of a keyswitch according to another embodiment of the present invention.

As shown in FIG. 10, the keyswitch 104" includes the cap 106 and the support device 108". The support device 108" includes the first support member 110 and a second support member 112". The first support member 110 has the first connection portion 114, the second connection portion 116, and the first linkage portion 118. The second support member 112" has a third connection portion 136, the fourth connection portion 122, and the second linkage portion 124. The first connection portion 114 is slidably connected to the cap 106 (e.g. by utilizing the sliding shaft to be slidably disposed in the sliding slot mentioned in the aforesaid embodiment) along a horizontal direction A. The second connection portion 116 is slidably connected to the board 102 (e.g. by utilizing the shaft to be slidably disposed in the slot hole mentioned in the aforesaid embodiment) along the horizontal direction A. The third connection portion 136 is slidably connected to the cap 106 (e.g. by utilizing the sliding shaft to be slidably disposed in the sliding slot mentioned in the aforesaid embodiment) along the horizontal direction A. The fourth connection portion 122 is connected to the board 102 (e.g. by utilizing the shaft to be pivotably disposed in the shaft hole mentioned in the aforesaid embodiment) pivotably along a rotation direction B. The first linkage portion 118 and the second linkage portion 124 are movably connected to each other. Accordingly, with up-and-down movement of the cap 106, the second support member 112" slides relative to the cap 106, and the first support member 110 slides relative to the cap 106 and the board 102, so that elastic members on the first support member 110 and the second support member 112" could be biased respectively by stopping members on the cap 106 with sliding of the first support member 110 and the second support member 112" to provide an elastic force to the first support member 110 and the second support member 112". As for other related description for the keyswitch 104", it could be reasoned by analogy according to the aforesaid embodiments and omitted herein.

Figure 11:
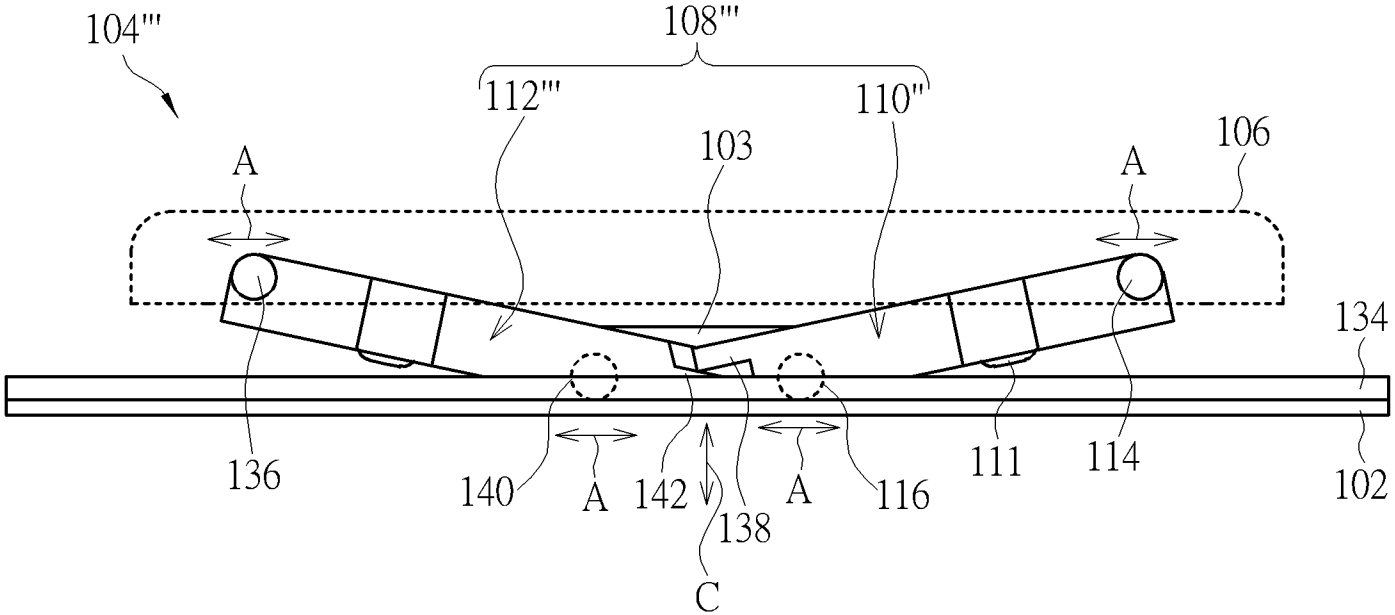
FIG. 11 is a side view of a keyswitch according to another embodiment of the present invention.

Moreover, please refer to FIG. 11, which is a side view of a keyswitch 104'" according to another embodiment of the present invention. For clearly showing the structural design of a support device 108'", the cap 106 is briefly depicted by dotted lines in FIG. 11. Components both mentioned in this embodiment and the aforesaid embodiments represent components with similar structures or functions.

As shown in FIG. 11, the keyswitch 104'" includes the cap 106 and the support device 108'". The support device 108'" includes a first support member 110" and a second support member 112'". The first support member 110" has the first connection portion 114, the second connection portion 116, and a first linkage portion 138. The second support member 112'" has the third connection portion 136, a fourth connection portion 140, and a second linkage portion 142. The first connection portion 114 is slidably connected to the cap 106 (e.g. by utilizing the sliding shaft to be slidably disposed in the sliding slot mentioned in the aforesaid embodiment) along the horizontal direction A. The second connection portion 116 is slidably connected to the board 102 (e.g. by utilizing the shaft to be slidably disposed in the slot hole mentioned in the aforesaid embodiment) along the horizontal direction A. The third connection portion 136 is slidably connected to the cap 106 (e.g. by utilizing the sliding shaft to be slidably disposed in the sliding slot mentioned in the aforesaid embodiment) along the horizontal direction A. The fourth connection portion 140 is slidably connected to the board 102 (e.g. by utilizing the shaft to be slidably disposed in the slot hole mentioned in the aforesaid embodiment) along the horizontal direction A. The first linkage portion 138 and the second linkage portion 142 are connected to each other in an up-and-down movable manner along a vertical direction C (e.g. by utilizing a shaft on the first linkage portion 138 to be movably disposed in a vertical slot hole on the second linkage portion 142). Accordingly, with up-and-down movement of the cap 106, the first support member 110" and the second support member 112'" slide relative to the cap 106 and the board 102, so that elastic members on the first support member 110" and the second support member 112'" could be biased respectively by stopping members on the cap 106 with sliding of the first support member 110" and the second support member 112' to provide an elastic force to the first support member 110" and the second support member 112'". As for other related description for the keyswitch 104''', it could be reasoned by analogy according to the aforesaid embodiments and omitted herein.

In summary, compared with the prior art design that the elastic member is disposed between the cap and the board for providing an elastic force, the present invention adopts the design that the first support member and the second support member are movably connected to the cap and the board to make the first support member slide relative to the cap with up-and-down movement of the cap. Accordingly, the stopping member could bias the elastic member with sliding of the first support member to cause deformation of the elastic member, so as to achieve the purpose that the deformed elastic member could provide an elastic force to drive the cap back to its original position automatically. In such a manner, the present invention could efficiently reduce the overall height of the keyswitch so as to be advantageous to the thinning design of the keyboard. Furthermore, since there is no need to dispose an elastic member between the cap and the board, the present invention could also extend the life of the keyswitch.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A keyswitch comprising:

a board;

a cap; and a support device disposed between the board and the cap, the support device comprising a first support member and a second support member, the first support member and the second support member being movably connected to the cap and the board to make the cap move between a non-pressed position and a pressed position with rotation of the first support member and the second support member, a stopping member being formed on one of the first support member and the cap, an elastic member being formed on the other one of the first support member and the cap to abut against the stopping member;

wherein when the cap is not pressed, the stopping member abuts against the elastic member to keep the cap at the non-pressed position; when the cap is pressed by an external force to move from the non-pressed position to the pressed position with rotation of the first support member and the second support member, the cap and the first support member slide to make the stopping member deform the elastic member; when the external force is released, the elastic member deformed by the stopping member provides an elastic force to drive the cap and the first support member to slide, so as to move the cap from the pressed position back to the non-pressed position.

2. The keyswitch of claim 1, wherein the stopping member is an engaging slot formed on the cap, the elastic member is a pivot shaft formed on the first support member, the pivot shaft is rotatably engaged with the engaging slot, the first support member slides relative to the cap to make the engaging slot deform the pivot shaft when the cap is pressed by the external force to move from the non-pressed position to the pressed position with rotation of the first support member and the second support member, and when the external force is released, the elastic member deformed by the stopping member provides the elastic force to drive the first support member to slide relative to the cap, so as to move the cap from the pressed position back to the non-pressed position.

3. The keyswitch of claim 1, wherein the first support member has a first connection portion, a second connection portion, and a first linkage portion, the second support member has a third connection portion, a fourth connection portion, and a second linkage portion, the first connection portion is slidably connected to the cap, the second connection portion is slidably connected to the board, the third connection portion is pivotably connected to the cap, the fourth connection portion is pivotably connected to the board, the first linkage portion and the second linkage portion are movably connected to each other to cause linkage movement of the first support member and the second support member when the cap is pressed or the external force is released, and when the cap is pressed by the external force, the second support member takes the fourth connection portion as a pivot point to rotate relative to the cap and the board and the first support member slides relative to the cap and the board.

4. The keyswitch of claim 3, wherein the first linkage portion and the second linkage portion are connected to each other in a shaft-hole fitting manner or are stacked with each other.

5. The keyswitch of claim 3, wherein the board has a connection base, a slot hole is formed on the connection base corresponding to the second connection portion, a shaft hole is formed on the connection base corresponding to the fourth connection portion, the second connection portion is slidably disposed in the slot hole, and the fourth connection portion is pivotably disposed in the shaft hole.

6. The keyswitch of claim 1, wherein the first support member has a first connection portion, a second connection portion, and a first linkage portion, the second support member has a third connection portion, a fourth connection portion, and a second linkage portion, the first connection portion is slidably connected to the cap, the second connection portion is slidably connected to the board, the third connection portion is slidably connected to the cap, the fourth connection portion is pivotably connected to the board, the first linkage portion and the second linkage portion are movably connected to each other to cause linkage movement of the first support member and the second support member when the cap is pressed or the external force is released, and when the cap is pressed by the external force, the second support member slides relative to the cap and the first support member slides relative to the cap and the board.

7. The keyswitch of claim 6, wherein the first linkage portion and the second linkage portion are connected to each other in a shaft-hole fitting manner or are stacked with each other.

8. The keyswitch of claim 6, wherein the board has a connection base, a slot hole is formed on the connection base corresponding to the second connection portion, a shaft hole is formed on the connection base corresponding to the fourth connection portion, the second connection portion is slidably disposed in the slot hole, and the fourth connection portion is pivotably disposed in the shaft hole.

9. The keyswitch of claim 1, wherein the first support member has a first connection portion, a second connection portion, and a first linkage portion, the second support member has a third connection portion, a fourth connection portion, and a second linkage portion, the first connection portion is slidably connected to the cap, the second connection portion is slidably connected to the board, the third connection portion is slidably connected to the cap, the fourth connection portion is slidably connected to the board, the first linkage portion and the second linkage portion are connected to each other in an up-and-down movable manner to cause linkage movement of the first support member and the second support member when the cap is pressed or the external force is released, and when the cap is pressed by the external force, the first support member and the second support member slide relative to the cap and the board.

10. A keyboard comprising:

a board; and a plurality of keyswitches disposed on the board, at least one of the plurality of keyswitches comprising:

a cap; and a support device disposed between the board and the cap, the support device comprising a first support member and a second support member, the first support member and the second support member being movably connected to the cap and the board to make the cap move between a non-pressed position and a pressed position with rotation of the first support member and the second support member, a stopping member being formed on one of the first support member and the cap, an elastic member being formed on the other one of the first support member and the cap to abut against the stopping member;

wherein when the cap is not pressed, the stopping member abuts against the elastic member to keep the cap at the non-pressed position; when the cap is pressed by an external force to move from the non-pressed position to the pressed position with rotation of the first support member and the second support member, the cap and the first support member slide to make the stopping member deform the elastic member; when the external force is released, the elastic member deformed by the stopping member provides an elastic force to drive the cap and the first support member to slide, so as to move the cap from the pressed position back to the non-pressed position.

11. The keyboard of claim 10, wherein the stopping member is an engaging slot formed on the cap, the elastic member is a pivot shaft formed on the first support member, the pivot shaft is rotatably engaged with the engaging slot, the first support member slides relative to the cap to make the engaging slot deform the pivot shaft when the cap is pressed by the external force to move from the non-pressed position to the pressed position with rotation of the first support member and the second support member, and when the external force is released, the elastic member deformed by the stopping member provides the elastic force to drive the first support member to slide relative to the cap, so as to move the cap from the pressed position back to the non-pressed position.

12. The keyboard of claim 10, wherein the first support member has a first connection portion, a second connection portion, and a first linkage portion, the second support member has a third connection portion, a fourth connection portion, and a second linkage portion, the first connection portion is slidably connected to the cap, the second connection portion is slidably connected to the board, the third connection portion is pivotably connected to the cap, the fourth connection portion is pivotably connected to the board, the first linkage portion and the second linkage portion are movably connected to each other to cause linkage movement of the first support member and the second support member when the cap is pressed or the external force is released, and when the cap is pressed by the external force, the second support member takes the fourth connection portion as a pivot point to rotate relative to the cap and the board and the first support member slides relative to the cap and the board.

13. The keyboard of claim 12, wherein the first linkage portion and the second linkage portion are connected to each other in a shaft-hole fitting manner or are stacked with each other.

14. The keyboard of claim 12, wherein the board has a connection base, a slot hole is formed on the connection base corresponding to the second connection portion, a shaft hole is formed on the connection base corresponding to the fourth connection portion, the second connection portion is slidably disposed in the slot hole, and the fourth connection portion is pivotably disposed in the shaft hole.

15. The keyboard of claim 10, wherein the first support member has a first connection portion, a second connection portion, and a first linkage portion, the second support member has a third connection portion, a fourth connection portion, and a second linkage portion, the first connection portion is slidably connected to the cap, the second connection portion is slidably connected to the board, the third connection portion is slidably connected to the cap, the fourth connection portion is pivotably connected to the board, the first linkage portion and the second linkage portion are movably connected to each other to cause linkage movement of the first support member and the second support member when the cap is pressed or the external force is released, and when the cap is pressed by the external force, the second support member slides relative to the cap and the first support member slides relative to the cap and the board.

16. The keyboard of claim 15, wherein the first linkage portion and the second linkage portion are connected to each other in a shaft-hole fitting manner or are stacked with each other.

17. The keyboard of claim 15, wherein the board has a connection base, a slot hole is formed on the connection base corresponding to the second connection portion, a shaft hole is formed on the connection base corresponding to the fourth connection portion, the second connection portion is slidably disposed in the slot hole, and the fourth connection portion is pivotably disposed in the shaft hole.

18. The keyboard of claim 10, wherein the first support member has a first connection portion, a second connection portion, and a first linkage portion, the second support member has a third connection portion, a fourth connection portion, and a second linkage portion, the first connection portion is slidably connected to the cap, the second connection portion is slidably connected to the board, the third connection portion is slidably connected to the cap, the fourth connection portion is slidably connected to the board, the first linkage portion and the second linkage portion are connected to each other in an up-and-down movable manner to cause linkage movement of the first support member and the second support member when the cap is pressed or the external force is released, and when the cap is pressed by the external force, the first support member and the second support member slide relative to the cap and the board.

* * * * *